United States Patent [19]

Bond

[11] Patent Number: 5,045,046

[45] Date of Patent: Sep. 3, 1991

[54] APPARATUS FOR OIL SEPARATION AND RECOVERY

[76] Inventor: Lesley O. Bond, 707 Peterson Rd., Neosho, Mo. 64850

[21] Appl. No.: 612,404

[22] Filed: Nov. 13, 1990

[51] Int. Cl.[5] ..... B04B 15/00

[52] U.S. Cl. ..... 494/10; 494/3; 494/60; 494/79

[58] Field of Search ..... 494/1, 2, 3, 5, 6, 7, 494/8, 10, 36, 43, 60, 74, 75, 76, 79, 56; 210/781, 782, 360.1

[56] References Cited

U.S. PATENT DOCUMENTS

| | | | |
|---|---|---|---|
| 720,154 | 2/1903 | Kimball . | |
| 793,222 | 6/1905 | Pawley et al. . | |
| 1,222,979 | 4/1917 | Okell . | |
| 1,542,401 | 6/1925 | Meer . | |
| 1,587,800 | 6/1926 | Saives . | |
| 4,284,232 | 8/1981 | Todd | 494/43 |
| 4,846,780 | 7/1989 | Galloway | 494/3 |

*Primary Examiner*—Robert W. Jenkins

*Attorney, Agent, or Firm*—Laney, Dougherty, Hessin & Beavers

[57] ABSTRACT

Apparatus for cleaning dirt/oil/water mixtures that utilizes a rotating drum wherein the inner cylindrical wall of the drum includes a plurality of V-shaped troughs secured in continuous circumferential array with each vee or apex directed radially outward and secured to the inner drum wall. Canted baffle plates of triangular shape are then secured within each trough with triangle base secured at the vee open top and the triangle apex secured at the vee apex. Input dirty oil having water and dirt suspended is input at one end of the drum proximate the base ends of the baffle plates while lighter weight oil products are separated inward along the axis of the drum and heavy dirt and water materials are driven to the baffle apex points from which they may be extracted.

14 Claims, 6 Drawing Sheets

APPARATUS FOR OIL SEPARATION AND RECOVERY

BACKGROUND OF THE INVENTION

1. Field of the Invention The invention relates generally to centrifugal separator apparatus for cleaning of oil product and, more particularly, but not by way of limitation, it relates to an improved form of centrifugal separator that employs a plurality of flow directing vanes and other improvements that maximize throughput of oil/water impurity liquids.

2. Description of the Prior Art

The prior art includes numerous types of centrifugal separator ranging from the various forms of cyclone separator to the drum separators that have been devised for specific applications. There are very few if any teachings in the prior art that relate to the centrifugal separation of crude oil from impurities with the exception of the well-known de-sander equipment which generally takes the form of the basic cyclone separator per se. U.S. Pat. Nos. 720,154 and 793,222 are of interest as regards general similarities in structure of the present invention; however, these patents relate to the treatment of milk/cream mixture separation and the characteristic problems attendant thereto. The U.S. Pat. No. 720,154 uses fluted side walls in a cylinder revolving about a vertical axis but the flutes or vanes all lie in parallel relationship to the axis albeit that they are utilized in a concentric array with milk flow passages distributed along each vane. Final milk separation is achieved at the bottom along the central axis. U.S. Pat. No. 793,222 has similarities to the above as the separator vanes are all parallel and perforate to perform a straining function under centrifugally induced pressure. U.S. Pat. No. 1,587,800 teaches a centrifugal separator for use with lubricating oil. This device operates more on the cyclone separator principal as the lighter oil is driven upward for spinoff through a series of radially directed upper tubes. U.S. Pat. Nos. 1,222,979 and 1,542,401 have also been suggested for showing general similarities of structure.

SUMMARY OF THE INVENTION

The present invention relates to centrifugal separators for contaminated water-laden crude oil or other heavy, inhomogenous mixtures. The invention consists of a drum rotating on a vertical or horizontal axis and including a plurality of equi-spaced flutes with canted flow baffles disposed about the inside cylinder wall. An oil mixture containing water and other impurity is input to the rotating drum interior for release at a first position nearest the axis of revolution and the centrifugal motion combined with movement along the canted interior baffles forces the heavier water/impurities to an outermost radial position while the purified oil can be removed from a position closely adjacent the axis of revolution. Radially aligned sensors provide continual indication of the disposition of the oil/water make-up within the rotating drum, and a plurality of equi-spaced paddles extend lengthwise in the drum in radial alignment to protect against slippage of the liquid within the rotating drum/flute combination.

Therefore, it is an object of the present invention to provide apparatus that is capable of rapidly cleaning large volumes of oil/water impurity mixtures in continuous feed manner.

It is also an object of the present invention to provide oil de-watering apparatus having a greater volume of throughput of the impure product.

It is yet further an object of the invention to provide oil cleaning apparatus that includes means continually indicating the oil/water content during operation.

Finally, it is an object of the present invention to provide apparatus of relatively simple and reliable construction for use in cleaning large volumes of contaminated oil product.

Other objects and advantages of the invention will be evident from the following description when read in conjunction with the accompanying drawings which illustrate the invention.

DETAILED DESCRIPTION OF THE INVENTION

Figure 1:
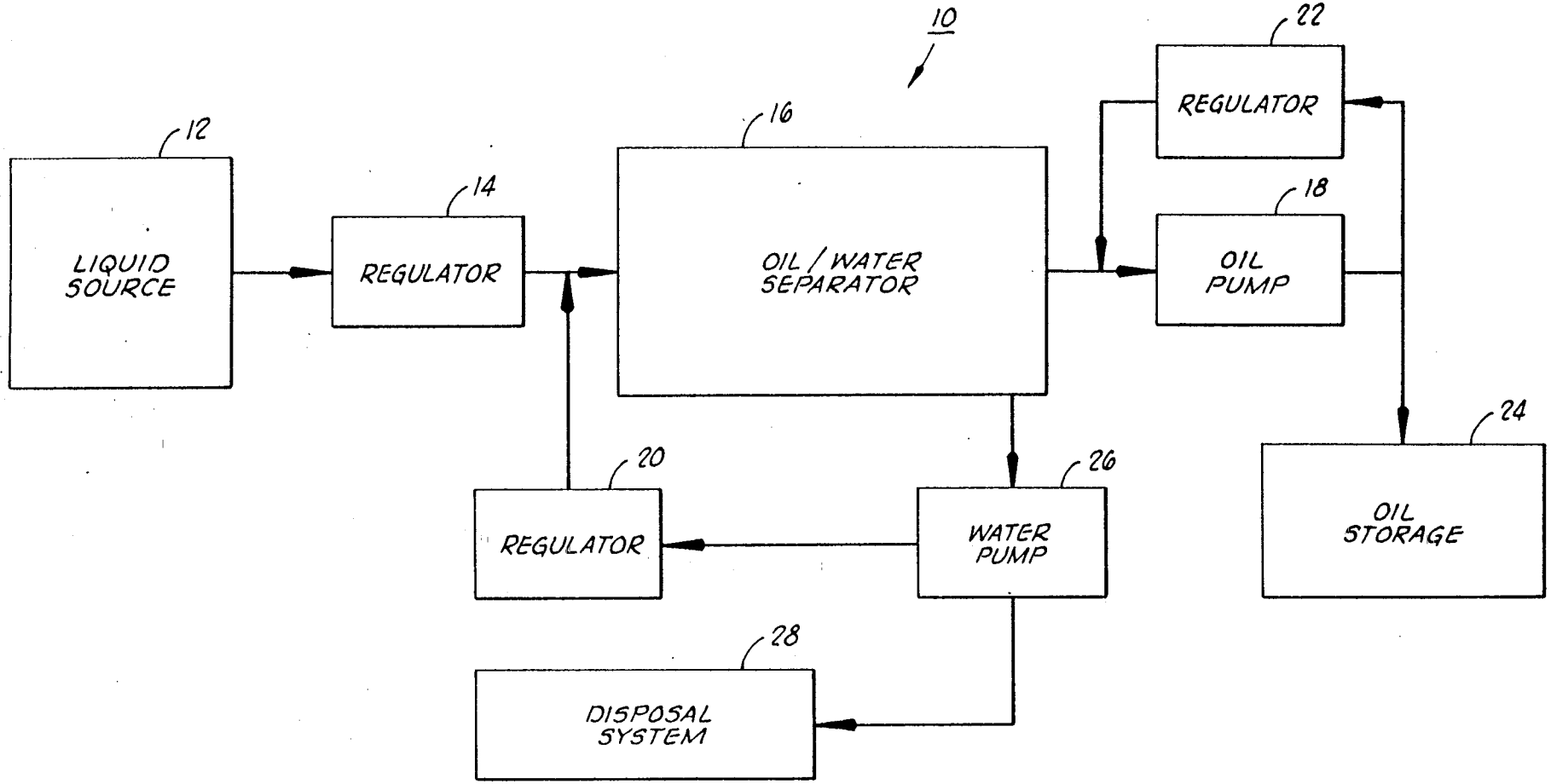
FIG. 1 is a block diagram of an oil cleansing system constructed in accordance with the present invention.

Referring to FIG. 1, an oil separation system 10 functions to recover relatively clean oil or crude oil from such as producing wells, storage tank bottoms, slush pits, emulsions and spill oil. Such oil product is represented by liquid source 12 which applies the contaminated oil through a regulator 14, e.g., a suitable valve, for input to an oil/water separator 16. The oil/water separator 16 rotates on a central axis and incorporates rotary unions (not shown) at each axial end to receive liquid input from regulator 14 as well as to provide liquid output to oil pump 18. Such rotary unions need continual presence of liquid for lubrication purposes, hence the use of a regulator 20 controlling flow of water back to the input side of oil/water separator 16, and a second regulator 22 feeding back oil from oil pump 18 to the associated rotary union. The bulk of recovered oil is pumped by oil pump 18 into oil storage 24, and recovered water flows by virtue of water pump 26 to a suitable disposal system 28 with the exception of that water drawn by regulator 20.

FIGS. 2-5 illustrate a preferred form of oil/water separator 30. While several drum configurations are illustrated herein, the matter of preference derives from the location of impurities extraction along the drum, i.e., end point versus intermediate points. The separator 30 consists of a drum 32 having a cylindrical side wall 34 and opposite, circular end walls 36 and 38. The drum is secured axially on an axle 40 which receives variable speed rotation by a selected electric motor (not shown), similar to motor 42 of FIG. 6. It is important that a large enough motor be selected that is capable of rotating the drum 32 at a relatively high RPM rate, as will be described.

Figure 3:
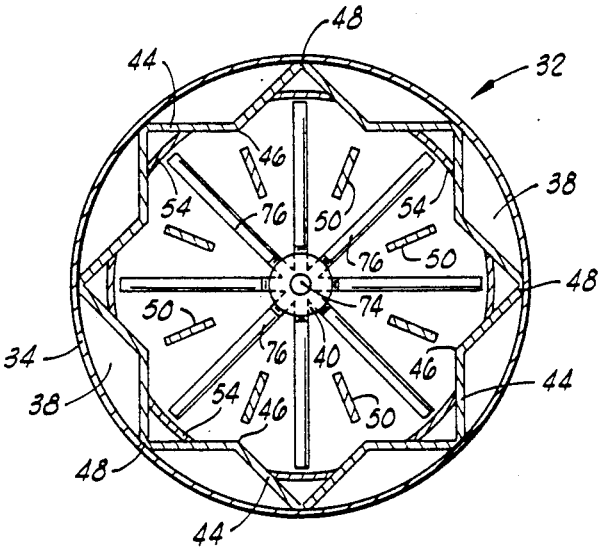
FIG. 3 is a cross section taken along lines 3—3 of FIG. 2.
Figure 4:
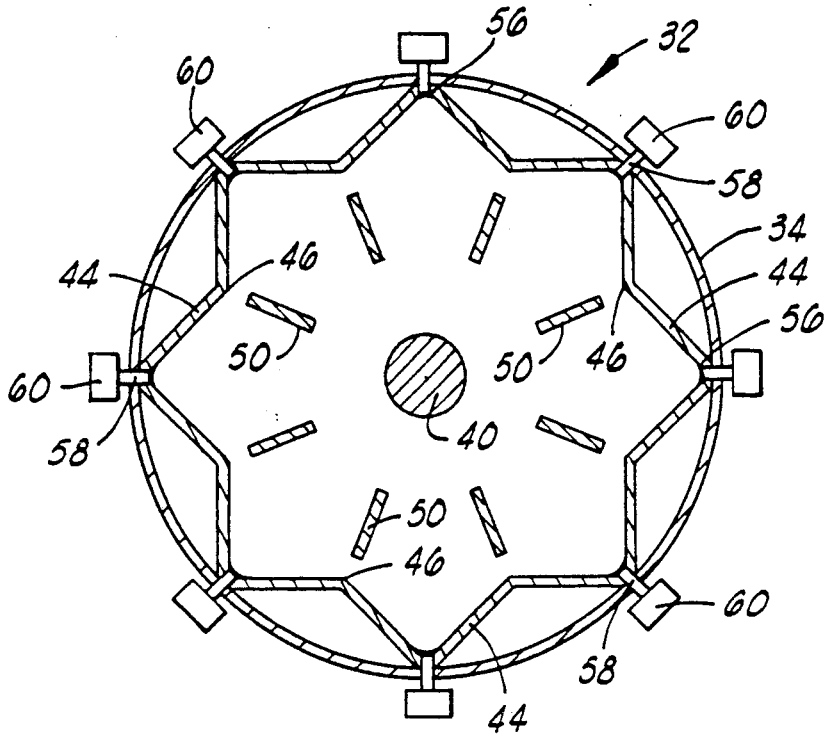
FIG. 4 is a cross section taken at lines 4—4 of FIG. 2.
Figure 5:
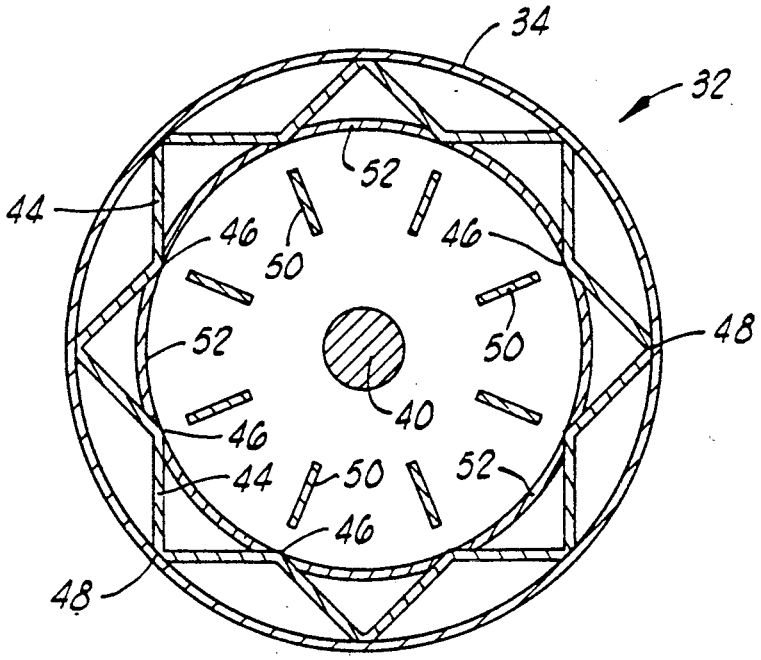
FIG. 5 is a cross section taken at lines 5—5 of FIG. 2.

The inside of drum 32 includes a plurality of V-shaped flutes 44 (see FIGS. 3–5) as they are arranged in continuous interconnection around the inside circumference of cylindrical wall 34. Thus, each upper side of a flute joins the adjoining flute at a peak 46 while each V-point 48 is secured to cylindrical wall 34. Adjacent each point 46 and spaced radially inward therefrom are a plurality of paddles 50 each of which extends the length of drum 32 and is affixed to opposite end walls 36 and 38. FIGS. 3, 4 and 5 provide good illustration of the internal placement of components within drum 32.

Within each of the V-shaped flutes 44 there is secured a flow way in the form of an arcuate, canted panel or baffle 52 on one side of drum 32 and similar canted panels or baffles 54 on the opposite side. Referring to the sectional FIGS. 3–5, it can be seen that the oppositely disposed canted baffles 52 and 54 each slope inward toward a point of greatest radius or dump point 56 wherein an orifice 58 is disposed at the V-point 48 for dump purposes. A respective solenoid 60 controls opening of the orifice 58 to allow dump either continuously or periodically as actuated. A suitable manifold 62 is placed around drum 32 in order to catch any effluent of water or impurities from orifice 58 for conduction to a suitable receptacle. The manifold 62 will require extensive seal structure adjacent the surfaces of rotary drum 32, e.g., TEFLON TM strips.

Oil plus impurity input is indicated by major arrow 64 through inlet pipe 66 to manifold 68. Manifold 68 with seals 70 rides on axle 40 to continually enclose the diametric bores 72, four or more, which are in communication with axial bore 74. The axial bore 74 extends for a short distance whereupon it communicates with a plurality, e.g., eight, of equi-spaced distribution tubes 76 (see FIG. 3) which conduct the impure liquid radially outward for release at an outer drum extremity adjacent a respective canted baffle 54. Thus, oil, water and impurities as input at 64 may be continually released at the outer extremities of drum 32 adjacent the canted baffles 54 within each respective V-shaped flow way 44. The lighter oil components will tend to seek an internal position along axle 40 while the heavier components of water and other sediments will work its way outward in drum 32 to be caught in one of the V-shaped flutes 44 while the canted baffles 52, 54 urge the heavies towards orifices 58. Cleansed oil product seeking position in around axle 40 will be released via plural diametric bores 80 in communication with an axial bore 82 that leads outward to a release flow point whereupon liquid may be conducted via pumping to oil storage 24 (FIG. 1).

Figure 6:
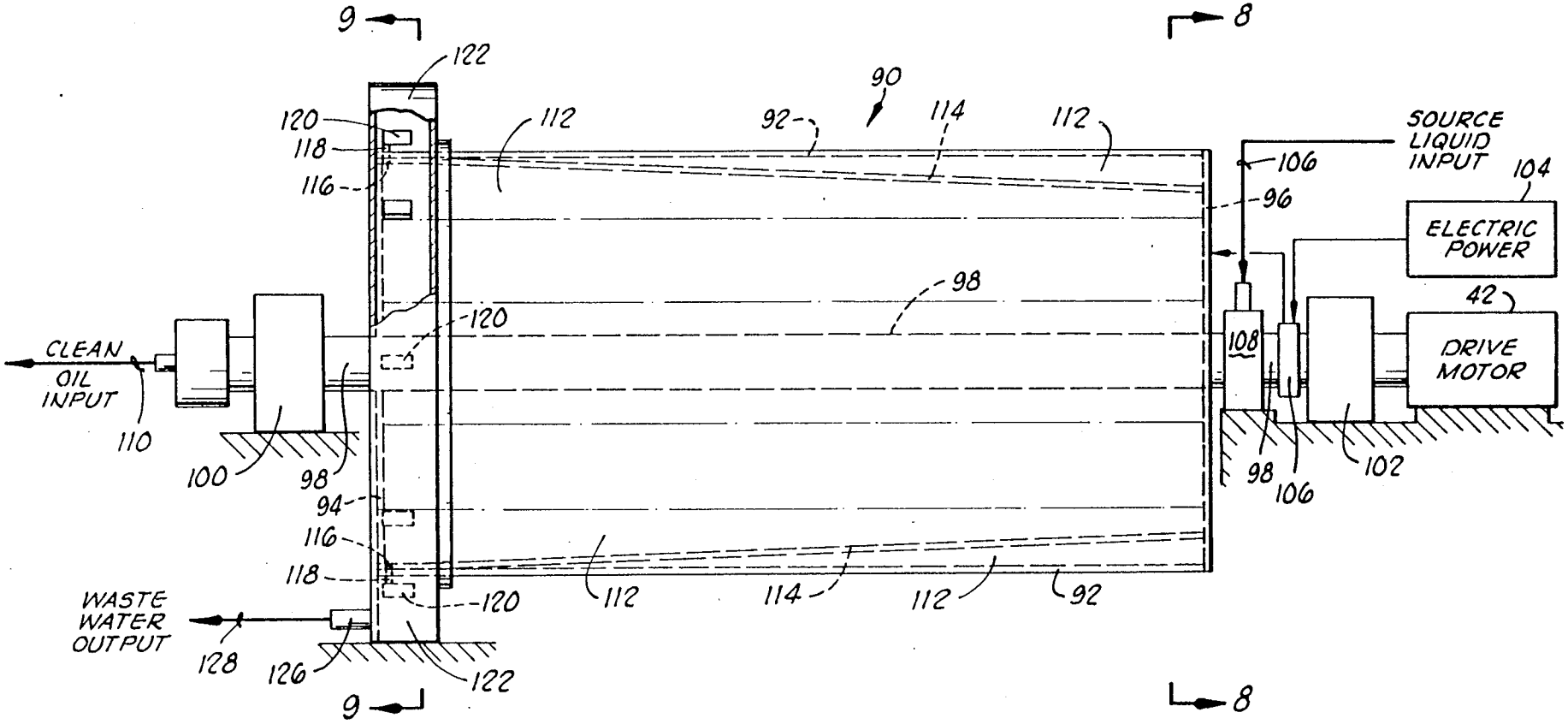
FIG. 6 is a view in elevation showing internal parts in dash-line of one alternative form of drum separator.

Referring now to FIG. 6, ancillary drive and piping structure is shown that may be utilized with any of the several variations of rotary drum that are disclosed herein. A rotary drum 90 is similar to rotary drum 30 in that it has a cylindrical wall 92 and end walls 94 and 96. The only difference between FIG. 6 and the basic system is the end dump configuration of drum 90. The drum 90 is secured at each of end walls 94 and 96 to an axle 98 rotatively supported within pillow block apparatus 100 and 102. The axle 98 receives drive rotation from a selected drive motor 42 and electric power from a source 104 may be input through a slip ring assembly 106 for solenoid control, etc. Unclean oil/water is applied for input via line 106 to manifold 108 for distribution through the axial input connection as aforedescribed in FIG. 2. Similarly, clean oil release is effected axially through axle 98 for output via line 110.

Figure 7:
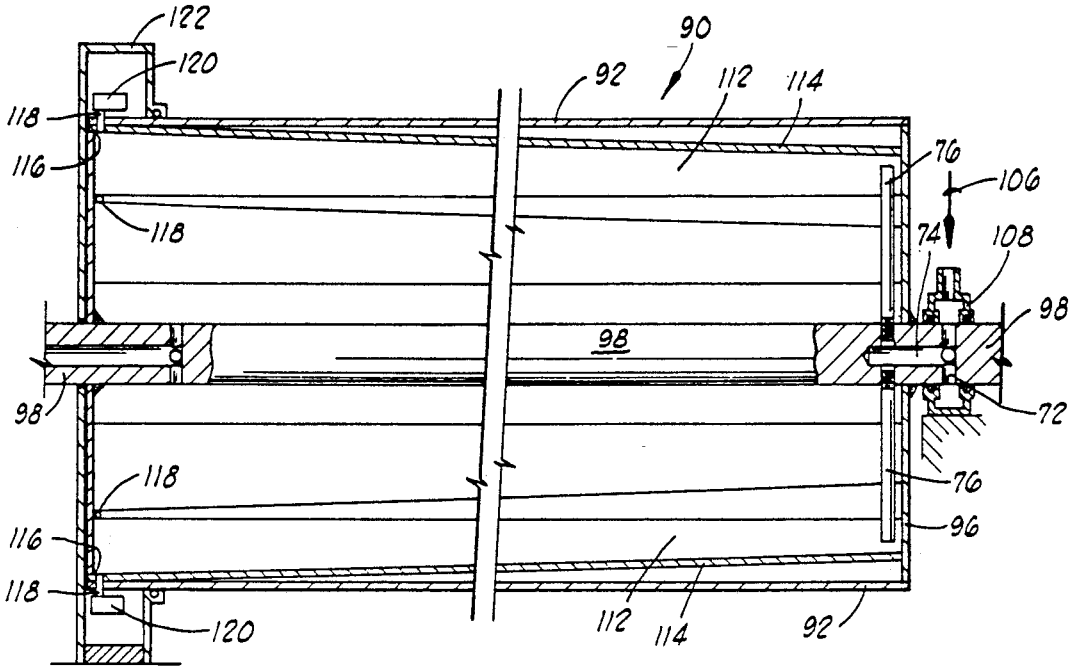
FIG. 7 is a view in vertical section showing interior components of the separator drum of FIG. 6.
Figure 8:
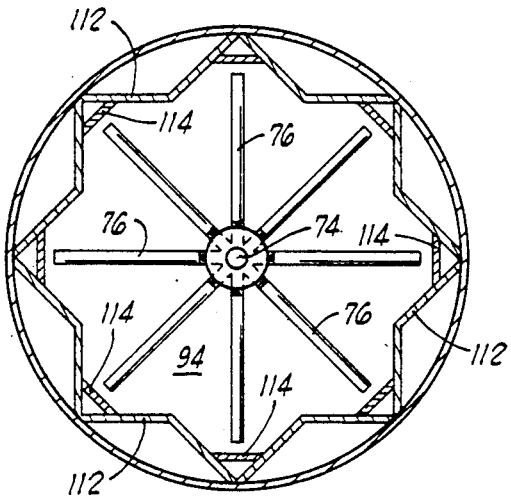
FIG. 8 is a section taken long lines 8—8 of FIG. 6.
Figure 9:
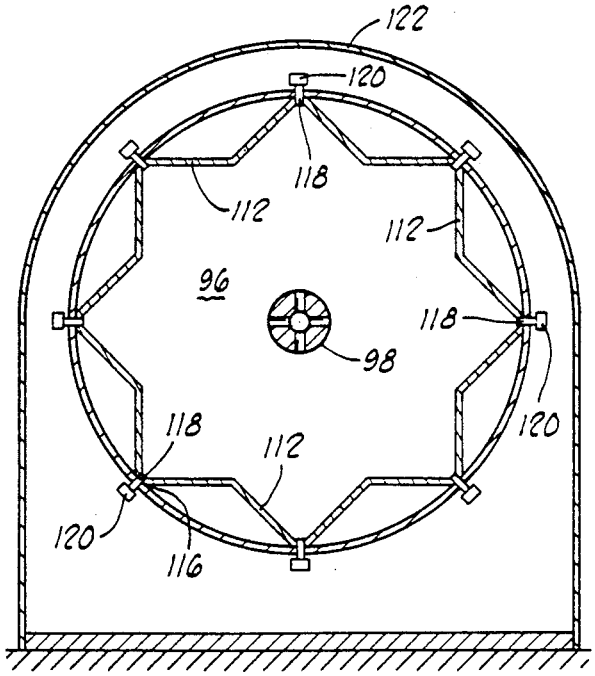
FIG. 9 is a cross section taken along lines 9—9 of FIG. 6.

Drum 90 includes the usual continuous lining of V-shaped troughs or flutes 112 as shown in FIGS. 7, 8 and 9; however, the canted baffle inserts 114 within V-shaped flutes 112 extend the length of drum 90. Thus, the heavy components, water and sediments, are forced down along baffles 114 during rotation to seek the outward most position centrifugally and this would lead to the end dump points 116 which include the respective dump orifices 118 and control solenoid 120 as spaced around the cylinder end wall 94. A suitable manifold 122 is positioned to envelop the end wall 94 of drum 90 as well as all of the dump solenoid assemblies so that a bottom drain 124 allows conduction of effluent via line 128. Paddles 50 (FIG. 2) may also be utilized with the FIG. 6, 7 type of drum 90 since it is desirable to have the paddle devices to lessen liquid slide within the drum 90 during rotational operation.

Figure 10:
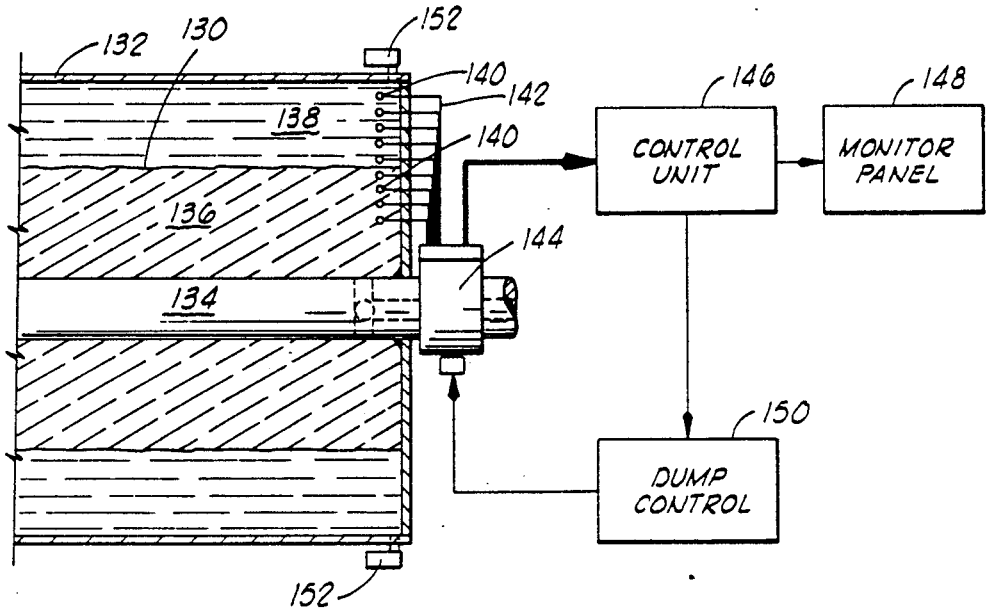
FIG. 10 is a block diagram with a section of drum separator showing the drum content monitor circuitry.

Quite often it is desirable to know the make-up of the liquid within the rotary drum; that is, the amount of oil versus the amount of water and other impurity or heavier liquids at the outer circumferal extremities. As shown in FIG. 10, a radial sensing system is operable to identify the instantaneous liquid interface 130. Thus, a drum 132 rotating on an axle 134 may include a central portion of lighter oil liquid 136 as the heavier water and sediment components 138 drift outward in the circumfery. A plurality of radially aligned sensors 140 provide an indication by simple conductivity check since the impure water will be a fairly good conductor while the oil will be insulative. Thus, each of the leads 142 is connected through a suitable slip ring assembly 144 for cable input to a control unit 146 which functions to determine the pair of contacts 140 which delineate a conduction/no conduction interface. This indication can then be presented on a monitor panel 148 or it can be responsive to actuate a presettable limit switch. This, in turn, can actuate a dump control 150 that provides output via lead 152 through slip rings 144 to actuate dump control solenoids 152 thereby to maintain interface 130 at a desired operating level consistent with desired throughput of oil product.

There are many different forms of sensor that might be utilized in providing a semi-automation or control of the oil separator equipment, and it is contemplated that programmed microcomputer equipment (not shown) can function to facilitate control of the oil separator while at the same time peaking the efficiency and increasing cleansed oil throughput.

Figure 11:
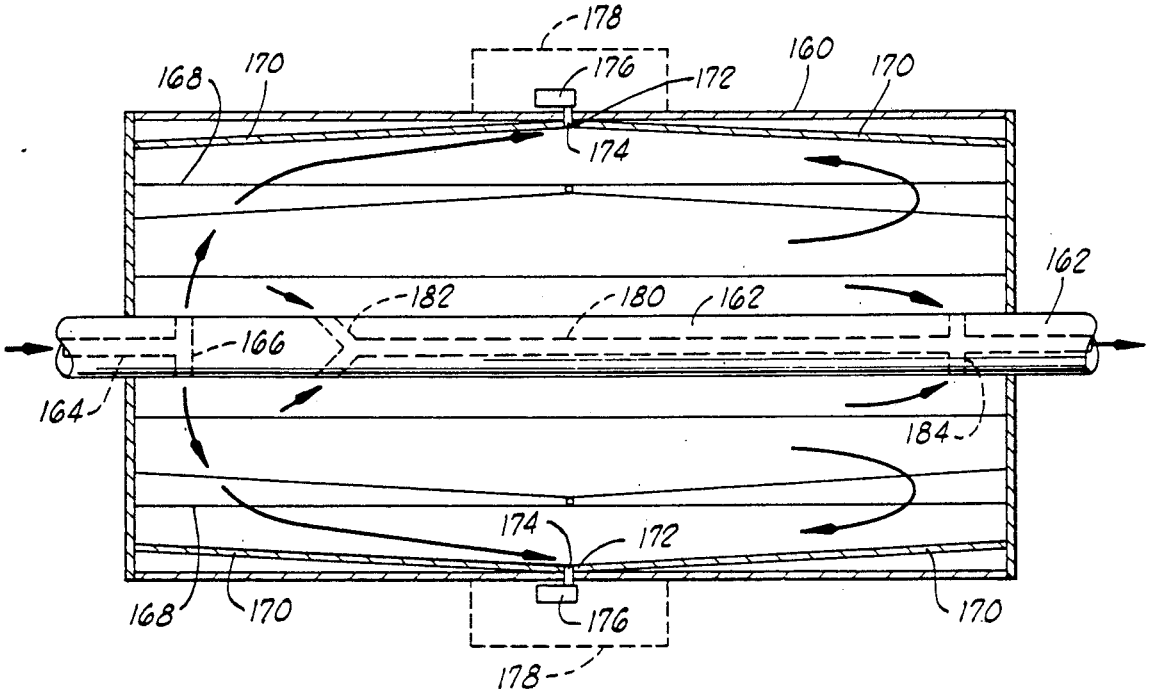
FIG. 11 is a view in vertical section of yet another form of drum apparatus constructed in accordance with the present invention.

FIG. 11 illustrates an alternative center dump rotary drum 160 secured for rotation on an axle 162. Input oil plus impurities is applied axially through axial bore 164 and dispersed through axle diametric bore 166 into the interior of rotary drum 160. A plurality of V-shaped flutes 168, continuous in disposition around the inner surface of drum 160, each includes a pair of oppositely canted flow baffles 170 directed to a central dump point 172. Located at the radially outermost dump point 172 are a dump orifice 174 and control solenoid 176 operating within manifold 178. This design also includes an elongated clear oil output as axial bore 180 extends three-fourths of the way across drum 160 in communication with a plurality of spaced radial inlet bores such as 182, 184.

Figure 2:
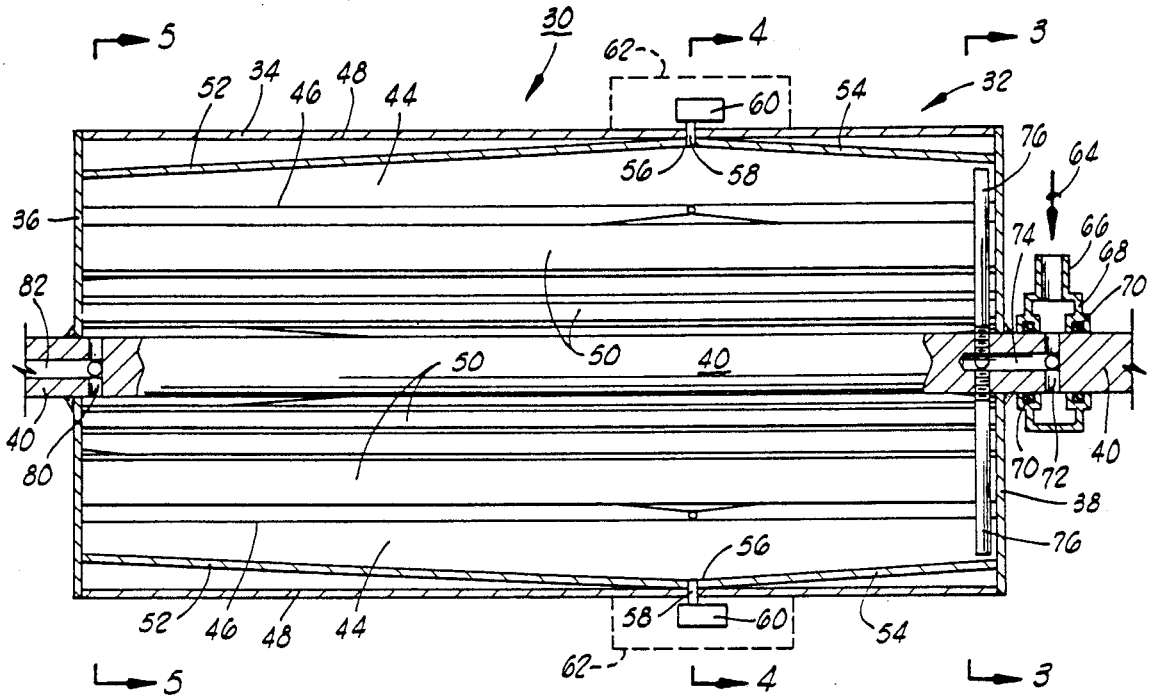
FIG. 2 is a view in vertical section of oil separation apparatus constructed in accordance with the present invention.

For discussion of operation, reference will be made primarily to FIGS. 1 and 2 and the drive system of FIG. 6. Referring to FIG. 1, a contaminated oil/water/sediment mixture as derived from liquid source 12 is applied as input 64 into axial input bore 74 and diametric distribution bores to the respective distribution tubes 76 (FIG. 3). Fluid flow should be adjusted so that both oil/water input and oil output should be adjusted by regulators 20 and 22 so that rotary unions supporting drum 32 receive fluid for lubrication. If the axle 40 at these rotary points should run dry it could cause hazard potential and even failure.

The input regulator 14 (FIG. 1) can be adjusted so that a continuous feed of oil/water mixture is applied into the distribution tubes 76 and separator drum 32. Drum 32 is a relatively sealed container such that the system can retain pressure during rotation and separation of constituent components.

The internal shape of drum 32 is designed to concentrate water and dirt at the various dump points by virtue of the heavies-directing structure consisting of the V-shaped flutes 4 and their canted baffles 52 and 54. It has been found that dirt concentration can be excessive in some instances and it may be desirable to adapt a small tubular screen over the input opening to orifices 58. It also may be desirable to inject additional water in order to stabilize the liquid mixture within the drum and eventually to flush excessive dirt or sediment out of the system. Additional water can be input through the input bore 82 of axle 40. In any event, as input oil/water/dirt is introduced under pressure in tubes 76 the relatively high speed rotation of drum 32 will force the heavies, water and sediments, radially outward against the flutes 44 with baffles 52, 54 while the lighter oil product will be forced to the inner drum extremities adjacent axle 40. The input pressure will exert fluid force throughout the drum 32 thereby forcing the cleaned oil through the mid-zone of drum 32 along axle 40 for evacuation through radial bores 80 and axial bore 82 to suitable clean oil handling facility.

In a current prototype design, the drum 32 has a capacity of about 150 gallons of oil product/water-dirt mixture. This is contained with a drum 32 that is about 60 inches long and 30 inches in diameter and rotating on a four-inch shaft. This particular size of unit results in retention of the oil/impurity mixture about three to four minutes within drum 32 as the fluid is processed completely through the system. A drum rotation of 500 revolutions per minute (RPM) develops centrifugal force of approximately 17 PSI. It has been found most effective to operate at speeds of about 1000 RPM and this results in a force of about 80 PSI.

It is most desirable to have some form of internal sensing mechanism such as that illustrated in FIG. 10 to provide a continual detection and tracking of the oil/-water interface within the separator drum. While a number of different types of liquid sensor may be used to differentiate between oil and water presence, a very effective yet simple mechanism is a conductivity check as effected by a plurality of leads 142 interconnected with a radial alignment of equi-spaced conductor probes 140 which respond conductively to the drum frame 132 only in the presence of water and impurities 138. The more central oil body 136 is an adequate insulator and will not allow completion of a electrical circuit from probes 140 to the drum ground or other circuit completion.

The probe 140 indications are then conducted through commutator 144 for input to control unit 146 which can determine from the condition of the alignment of probes 140 where the interface 130 is located, and this information can be displayed on monitor panel 148 or other indicator means. In addition, the oil/water interface data can be used to operate a dump control 150 as pre-set in accordance with specific limits. Adjustment of the oil/water interface is an indirect indication of the overall throughput progress of the system, and dump control 150 in effect enables automation of the processing system.

The foregoing discloses a novel form of oil/water separator that is capable of reliable operation to clean up even the most contaminated oil/water mixtures as derived from storage tank bottoms, open sludge pits and the like. The present system is relatively inexpensive and it can be assembled in compact manner such that an installation can be readily moved from point-to-point with minimum set-up time required to commence operation. The system is able to accommodate oil/water impurity throughput in proportion to a function of separator drum size and rotation rate, and a system can be readily devised for handling any size application.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for extraction of oil from a water/dirt-/oil mix, comprising:

a container having an axis of revolution, first and second ends, and a side wall consisting of plural, V-shaped flutes forming a continuous side wall as flute open tops are joined contiguously and apex folds are directed radially outward from the axis;

a plurality of triangular baffles having base and apex, each secured within a respective flute with base adjacent the first end wall and the triangle apex secured at a first point within the apex fold of the flute;

shaft means secured along the axis of revolution of the container;

means for controllably rotating the shaft means;

input means for releasing the water/dirt/oil mix adjacent the triangular baffles at the first end wall;

first output means connected through the triangle apex to conduct water/dirt heavies to the exterior; and second output means proximate the container axis of revolution at the second end wall to conduct oil product lighter components for recovery.

2. Apparatus as set forth in claim 1 which is further characterized to include:

a radial array of oil-responsive sensors disposed in said container; and means for receiving signal indication from said sensors and providing a visual indication of container content by delineating a radial separation of oil versus heavier contaminants.

3. Apparatus as set forth in claim 1 which is further characterized in that:

the first points where the triangle apices are secured are spaced about two-thirds of the axial distance from the first end wall; and a plurality of second triangular baffles having base and apex, are each secured within a respective flute with base adjacent the second end wall and the triangle apex also secured at said first point.

4. Apparatus as set forth in claim 1 which is further characterized to include:

a plurality of paddles are secured to extend the length of the container as disposed in equi-spaced array half-way between the container axis and the flute open tops.

5. Apparatus as set forth in claim 1 which is further characterized in that:

each of said triangular baffles is formed as an arcuate surface to slope centrally along the triangle height dimension, said slope urging toward the housing inner wall.

6. Apparatus for oil separation and recovery from an oil/dirt/water liquid mix, comprising:

a cylindrical housing having an inner wall and first and second end walls;

a shaft extending axially through the cylindrical housing and being secured to said first and second end walls;

a plurality of V-shaped flutes having an open top and an apex, secured around the housing in continuous outward pointing direction with the apex secured to the cylinder inner wall;

a plurality of canted baffles of triangular shape having base and apex and secured within respective V-shaped flutes with the base secured at the open top of each vee adjacent the first end wall and the triangle apex extending to the apex of the vee at a second point to direct liquid flow longitudinally in said V-shaped flutes;

means for rotating said shaft and cylindrical housing;

axial input means for conducting liquid mix oil into the cylindrical housing for release adjacent the first end wall;

axial output means formed as a bore through said shaft adjacent the second end wall for release of lighter oil products; and a circumferential output formed through the V-shaped flutes and the cylindrical housing at said second points for release of heavier contaminants.

7. Apparatus as set forth in claim 6 wherein said axial input means comprises:

at least one radial bore formed through said shaft external to the end wall and in communication with an axial bore extending through said shaft to within the first end wall; and plural release tubes affixed radially to said shaft in communication with said axial bore to conduct input oil/dirt/water mix.

8. Apparatus as set forth in claim 6 wherein said axial output means comprises:

at least one radial bore formed through said shaft internal to the second housing end wall and an axial bore formed in the shaft to communicate between the at least one radial bore and the exterior.

9. Apparatus as set forth in claim 8 which is further characterized to include:

reservoir means situated exteriorally for continually receiving and storing oil from the axial bore of the axial output means.

10. Apparatus as set forth in claim 6 wherein said circumferential output comprises:

a plurality of output conduits formed in spaced, uniplanar array around said cylindrical housing; and a manifold formed around said cylindrical housing in rotationally sealed affixture to enclose each of the output conduits thereby to continually collect and convey the output heavy contaminants.

11. Apparatus as set forth in claim 6 wherein:

said plurality of canted baffles are each positioned with the base adjacent one end wall and extending the apex to a uniplanar circumferential position.

12. Apparatus as set forth in claim 11 which is further characterized to include:

a second plurality of triangular shaped canted baffles having base and apex with the base secured in the open top of each vee at a third point adjacent the second end wall and the apex secured to the apex of the vee at said second point.

13. Apparatus as set forth in claim 6 which is further characterized to include:

a linear array of oil-sensitive sensors positioned radially in said cylindrical housing adjacent the second end wall; and means for indicating the condition of the sensors to show proportion of water/dirt heavies versus the lighter oil components during operation.

14. Apparatus as set forth in claim 13 wherein said means for indicating comprises:

slip rings operative with said shaft to provide electrical conduction between the cylindrical housing and external thereto;

an electric power source providing electric current through said slip rings;

means conducting electrical sensor indications through said slip rings;

means providing visual indication of sensor energization.

* * * * *